US007559991B2

(12) United States Patent
Burton et al.

(10) Patent No.: US 7,559,991 B2
(45) Date of Patent: Jul. 14, 2009

(54) APPARATUS FOR COATING ENGINE VALVES WITH PROTECTIVE COATINGS AND CURING THE COATINGS USING INFRARED RADIATION

(75) Inventors: David R. Burton, Salt Lake City, UT (US); Jeffrey C. Holm, Sandy, UT (US); James M. Yates, Sandy, UT (US)

(73) Assignee: High Performance Coatings, Inc., Bluffdale, UT (US)

( * ) Notice: Subject to any disclaimer, the term of this patent is extended or adjusted under 35 U.S.C. 154(b) by 378 days.

(21) Appl. No.: 11/458,634

(22) Filed: Jul. 19, 2006

(65) Prior Publication Data

US 2007/0227000 A1 Oct. 4, 2007

Related U.S. Application Data

(60) Provisional application No. 60/787,596, filed on Mar. 30, 2006.

(51) Int. Cl.
*B05C 5/02* (2006.01)

(52) U.S. Cl. ..... 118/641; 118/66; 118/320; 118/504; 118/505

(58) Field of Classification Search ..... 118/641, 118/66, 320, 504, 505; 427/425; 29/890.12–890.132; 123/188.3; 137/375
See application file for complete search history.

(56) References Cited

U.S. PATENT DOCUMENTS

| | | | | |
|---|---|---|---|---|
| 2,273,250 A | | 2/1942 | Charlton | 91/70.2 |
| 3,033,705 A | * | 5/1962 | Hanink et al. | 148/526 |
| 4,055,705 A | | 10/1977 | Stecura et al. | 428/633 |
| 4,476,150 A | | 10/1984 | Rose | 427/10 |
| 4,530,322 A | | 7/1985 | Yamada et al. | 123/188 AA |
| 4,554,897 A | | 11/1985 | Yamada et al. | 123/188 AA |
| 4,554,898 A | | 11/1985 | Yamada et al. | 123/188 AA |
| 4,686,348 A | | 8/1987 | Johns et al. | 219/121 PY |
| 4,787,736 A | | 11/1988 | Mori et al. | 251/368 |
| 5,084,113 A | | 1/1992 | Mori et al. | 148/127 |
| 5,169,621 A | * | 12/1992 | DiMaio et al. | 427/195 |
| 5,576,069 A | | 11/1996 | Chen et al. | 427/454 |
| 5,655,493 A | | 8/1997 | Enright et al. | 123/188.3 |
| 5,662,078 A | | 9/1997 | Adegawa | 123/188.3 |
| 5,688,564 A | | 11/1997 | Coddet et al. | 427/554 |
| 5,759,640 A | | 6/1998 | Mannava et al. | 427/554 |
| 5,799,683 A | | 9/1998 | Hamada et al. | 137/15 |

(Continued)

OTHER PUBLICATIONS

Buyukkaya, E., Key Engineering Materials v. 264-268 n I 2004.p 517-520, Proceeding of the 8th Conference and Exhibition of the European Ceramic Society, 2004(49):6796 Compendex.

(Continued)

*Primary Examiner*—Laura Edwards
(74) *Attorney, Agent, or Firm*—Workman Nydegger

(57) ABSTRACT

A system for applying a coating to an engine valve and curing the coating using infrared radiation includes a spraying device, an infrared oven, and a movable track. A plurality of engine valves is transported through the system on the movable track. The spraying device applies a protective coating composition on a portion of the engine valves. The coating composition has a high emissivity value that allows the coating to be rapidly and efficiently cured as the coated engine valves travel through the infrared oven.

23 Claims, 6 Drawing Sheets

U.S. PATENT DOCUMENTS

| | | | | |
|---|---|---|---|---|
| 5,823,158 | A | 10/1998 | Heinmann, Jr. et al. | 123/188.3 |
| 6,129,954 | A | 10/2000 | Spitsberg et al. | 427/452 |
| 6,238,847 | B1 | 5/2001 | Axtell, III et al. | 430/322 |
| 6,257,190 | B1 | 7/2001 | Linebarger | 123/188.3 |
| 6,296,909 | B1 | 10/2001 | Spitsberg et al. | 427/452 |
| 6,296,910 | B1 | 10/2001 | Choy et al. | 427/475 |
| 6,298,817 | B1 | 10/2001 | Hoeg | 123/188.3 |
| 6,443,115 | B1 | 9/2002 | Hoeg | 123/188.3 |
| 6,541,075 | B2 | 4/2003 | Hasz et al. | 427/454 |
| 6,660,090 | B2 | 12/2003 | Choy et al. | 118/624 |
| 6,694,961 | B2 | 2/2004 | Miura et al. | 123/681 |
| 6,753,090 | B2 | 6/2004 | Haug et al. | 428/472 |
| 6,832,577 | B2 * | 12/2004 | Nesbitt | 118/713 |
| 2004/0105939 | A1 | 6/2004 | Haug et al. | 427/446 |
| 2004/0138058 | A1 | 7/2004 | Sambasivan et al. | 502/208 |

OTHER PUBLICATIONS

Kawana, A., Surface & Coatings Technology v 86-87 n 1-3 pt 1 Dec. 1, 1996.p 212-217, Proceedings of the 1996 23rd International Conference of Metallurtical Coating and Thin Films, 1997(13):2038 Compendex.

Lee, Ceramic Engineering and Science Proceedings v 20 n 3 1999.p 145-152, Proceedings of the 1999 23rd Annual Conference on Composites, Advanced Ceramics, Materials, and Structures, 2000(13):3717 Compendex.

Engleman, P.G., Surface Engineering v 18 n 2 2002.p 113-119, 2003(5):783 Compendex.

Herzog, CFI Ceramic Forum International v 79 n 8 Aug. 2002 2002.p D15-D17+E14-E16; 2002(38):3338 Compendex.

* cited by examiner

APPARATUS FOR COATING ENGINE VALVES WITH PROTECTIVE COATINGS AND CURING THE COATINGS USING INFRARED RADIATION

CROSS-REFERENCE TO RELATED APPLICATION

This application claims the benefit under 35 U.S.C. § 119 (e) of U.S. Provisional Application Ser. No. 60/787,596, filed Mar. 30, 2006 in the names of David R. Burton, Jeffrey C. Holm and James M. Yates, and entitled "Methods For Coating Engine Valves With Protective Coatings Using Infrared Radiation", the disclosure of which is incorporated herein in its entirety.

BACKGROUND OF THE INVENTION

1. The Field of the Invention

The present invention relates to an apparatus for coating engine valves with a protective coating on at least a portion of the engine valve. More particularly, the present invention relates to an apparatus for curing a coating on an engine valve using infrared radiation.

2. Related Technology

Engine valves are subject to severe temperatures, chemicals, pressures, and wear. Eventually the wear and tear on an engine valve will cause it to fail, necessitating repair or replacement. It is well known in the art to improve the life of an engine valve by making the part out of stronger materials such as high performance alloys.

One problem with many of the high performance alloys is the cost associated with making and machining the valve. Non-corrosive metal alloys are typically very expensive to make. In addition, the hardness of many metal alloys makes them very expensive to machine. For example, nickel or cobalt alloys are often used where hardness is needed. However, nickel and cobalt alloys are so hard that they typically have to be machined using diamond coated tools.

Another approach to improving the performance and wear of engine parts is to coat the parts with a ceramic coating. Protecting engine parts using ceramic coatings is also difficult and expensive to carry out. The time and temperatures at which many ceramic coatings are applied significantly increases manufacturing cost. For example, many ceramic coatings require a sintering step that is performed at 1600-2500° F. for an extended period of time. The energy and time required to perform the sintering step can make applying the coating cost prohibitive. Another problem with applying a ceramic coating is the need to apply the coating evenly. If the coating runs or pools, even a coating that is initially applied in an even manner can become uneven before it is baked in place.

BRIEF SUMMARY OF THE INVENTION

The present invention relates to a system for applying a protective coating to a portion of an engine valve and curing the coating using infrared radiation. The system allows for mass production of coated valves by facilitating the application of an even coating and rapidly curing the coating using infrared radiation.

The system of the present invention includes at least one infrared oven and a movable track that that passes through the infrared oven. The system also includes a plurality of attachment apparatus connected to the movable track that are configured to receive and hold an engine valve on the track as the track moves. A spraying device is positioned along the movable track before the infrared oven. The spraying device is configured to apply a coating to a portion of the engine valve, which is then cured in the infrared oven. The engine valves can be masked to prevent coating of any portion of the valve that is not desired to be coated (e.g., the valve seat).

The composition that is coated on the engine valve using the spraying device is selected to have a flowability in the spraying device that facilitates an even application of the coating on the engine valve. In addition, the coating composition is curable under infrared radiation. The protective coatings of the present invention typically include the following three components: (i) a metal and/or a ceramic material, (ii) a binder, and (iii) a solvent. Examples of suitable metals and ceramic materials include silicon, zinc, zirconium, magnesium, manganese, chromium, titanium, iron, aluminum, noble metals, molybdenum, cobalt, nickel, silica, calamine, zirconia, magnesia, titania, alumina, ceria, scandia, yttria, among others. Examples of suitable binders include ethylene copolymers, polyurethanes, polyethylene oxides, various acrylics, paraffin waxes, polystyrenes, polyethylenes, cellulosics, "agar," soda silicate, kairome clay, titania and aluminum phosphate, among others. Examples of suitable solvents include polar solvents such as water, methanol, and ethanol and non-polar organic solvents such as benzene and toluene.

The protective coating compositions are made by mixing a metal and/or metal oxide, a binder, and a solvent to form a paste or slurry. The metals, metal oxides, binders, and solvents are selected to give the coating a desired emissivity such that it will efficiently absorb infrared radiation. In a preferred embodiment, the emissivity of the coating composition is greater than about 0.7, more preferably greater than about 0.90, and most preferably greater than about 0.95.

After the coating is applied to the engine valve, the engine valve is transported through the infrared oven. Infrared radiation from the oven heats the coating layer to a temperature in a range from about 100° C. to about 650° C., more preferably in a range from about 200° C. to about 550° C., and most preferably in a range from about 250° C. to about 450° C. The infrared heating bonds, volatilizes, and/or burns off most or all of the solvent and optionally some or all of the binder. As the solvent is removed, the binder, metal, and/or ceramic materials react and/or sinter to form a protective coating that is corrosion and heat resistant. During the curing phase, the protective coating bonds to the surface of the valve thereby forming a permanent composition barrier.

Curing the coating using infrared radiation is advantageous because the coating can be cured quickly and economically. The high emissivity of the coating efficiently absorbs the infrared radiation. The masking and/or non-coated portions of the valve typically have or can be made to have low emissivity such that energy is not absorbed by these areas, but is reflected. One reason why the coatings of the present invention cure more quickly is because infrared radiation can penetrate beyond the surface of the coating. Thus, the coating is cured at various depths without the need to wait for the conduction of the heat through the layer. This feature is also partially responsible for the ability to cure at lower temperatures than typical ceramic composition. In addition, by focusing the heat at the coating, the curing temperatures can be reached without heating the entire part to a high temperature.

In a preferred embodiment, the coating is cured in the infrared oven for less than about 0.5 hour, more preferably less than about 20 minutes, and most preferably for less than about 5 minutes. The ability to cure relatively quickly and/or at relatively low temperatures can dramatically reduce the energy requirements for applying the coating.

In an exemplary embodiment, the system can include a preheater that heats the engine valve before the sprayer applies the coating. Preheating the engine valve can be advantageous to ensure that the coating cures rapidly and to reduce the tendency of the coating material to run or pool before it is cured (e.g., wherein heat from the preheated part helps remove a portion of the solvent after application of the coating to the valve).

In an exemplary embodiment, the attachment apparatus rotates (i.e., spins) as it moves along on the movable track. In a preferred embodiment, the attachment apparatus spins at desired stages of the system such as while the engine valves are being sprayed by the spraying device, heated by the preheater, and/or cured in the infrared oven. This rotation can be advantageous because it ensures more even heating, curing, and/or spray coating.

Optionally, the system of the present invention can include a control panel whereby the speed of the track can be electronically timed. In addition, the control panel can be configured to control the temperature of the infrared oven and/or preheater and/or the pressure or volume of the spray applied by the spraying device. The automatic control of one or more of the foregoing features of the system reduces the man power needed to applying the coatings to engine valves and can reduce errors associated with human application or control of applying and curing the coating.

In one embodiment of the invention, the attachment apparatus and an engine valve form an assembly. The assembly holds the engine valve on the track and masks a portion of the engine valve (e.g., the valve seat) to prevent that portion from being coated. The attachment apparatus includes a body of material having an upper surface configured to receive an engine valve. The engine valve includes a valve head and a valve stem. The valve head has a valve seat and comprises a bell region and an end surface region. At least a portion of the end surface region is disposed on the upper surface of the attachment apparatus. In one embodiment, the attachment apparatus includes a magnet to hold the bell region on the upper surface of the attachment apparatus. A masking ring is slidably received over a portion of the valve head and the body head so as to sandwich at least a portion of the valve head between the body head and the masking ring. The masking ring provides a mask for at least a portion of the valve seat.

These and other advantages and features of the present invention will become more fully apparent from the following description and appended claims as set forth hereinafter.

BRIEF DESCRIPTION OF THE DRAWINGS

To further clarify the above and other advantages and features of the present invention, a more particular description of the invention will be rendered by reference to specific embodiments thereof which are illustrated in the appended drawings. It is appreciated that these drawings depict only typical embodiments of the invention and are therefore not to be considered limiting of its scope. The invention will be described and explained with additional specificity and detail through the use of the accompanying drawings in which.

DETAILED DESCRIPTION OF EXEMPLARY EMBODIMENTS

I. Introduction

The present invention relates to a system for applying a coating to an engine valve and curing the coating using infrared radiation. The system includes a spraying device, an infrared oven, and a movable track. The engine valves are transported through the system on a movable track. The spraying device applies a protective coating composition that has a high emissivity value. The high emissivity value allows the coating to be rapidly and efficiently cured as the coated engine valve travels through the infrared oven.

II. High Throughput Coating And Curing System

Figure 1:
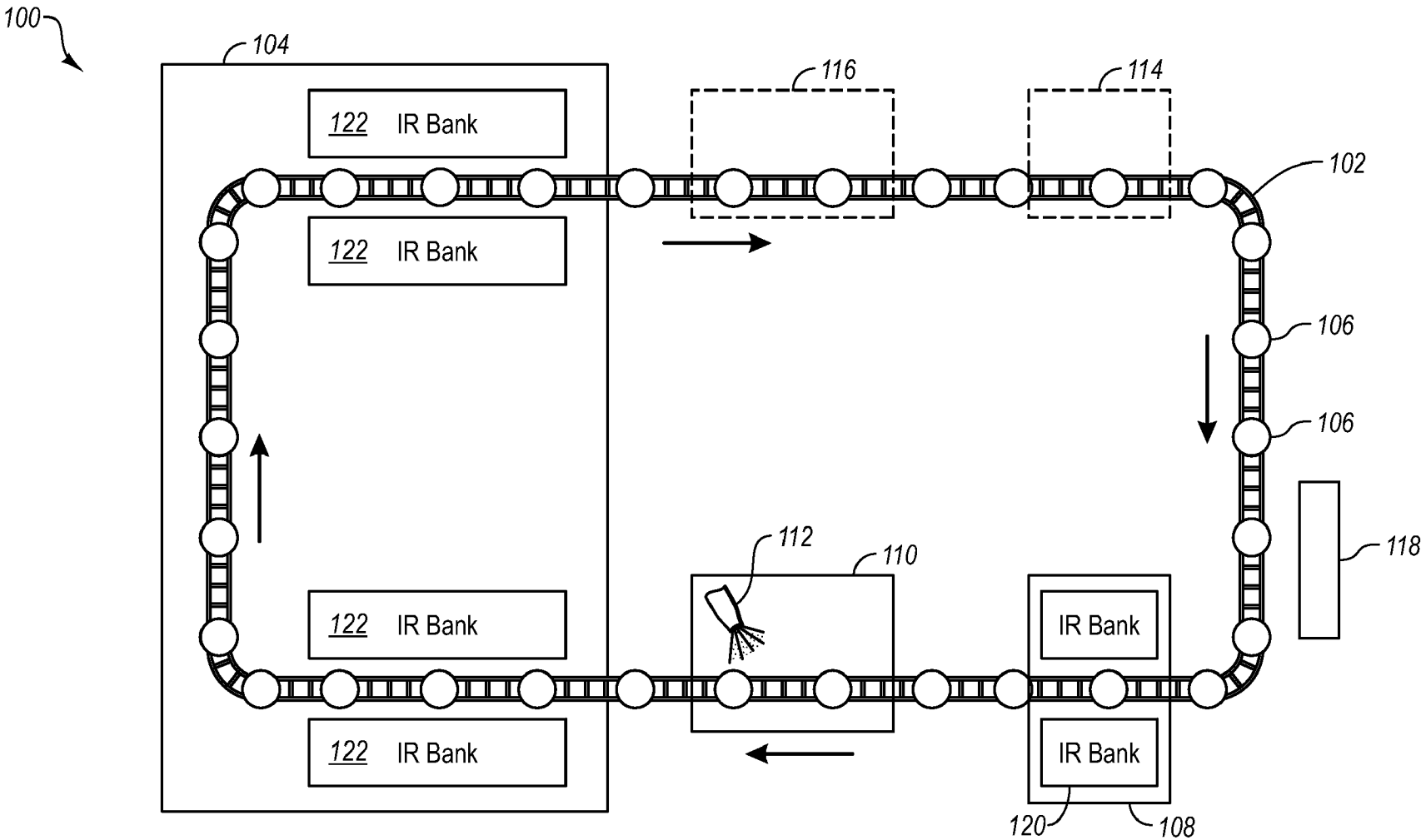
FIG. 1 is a schematic diagram illustrating an exemplary embodiment of the coating system of the present invention.

FIG. 1 shows an exemplary system 100 according to the present invention. System 100 generally includes a movable track 102 that passes through an infrared oven 104. A plurality of attachment apparatus (collectively referred to as apparatus 106) are connected to movable track 102. Each of the attachment apparatus is configured to hold an engine valve (not shown) that is transported through system 100 on movable track 102. System 100 can also includes a pre-heating oven 108 for preheating engine valves before they are coated with the coating composition. System 100 also includes a spraying region 110 where engine valves are spray coated using a spraying device 112. Along a portion of track 102 is a region 114 for placing uncoated engine valves on movable track 102 and another region 116 for removing engine valves that have been coated by system 100. Control panel 118 can be included to electronically control one or more components of system 100 (e.g., infrared oven 104 and track 102).

A. Movable Track

The movable track 102 can be made from any type of material and have any configuration so long as it can withstand the temperatures to which it will be exposed to in the oven and so long as the movable track 102 can securely transport the attachment apparatus and engine valves through system 100. In an exemplary embodiment, movable track 102 includes a plurality of apertures where attachment apparatus 106 can be slidably received. Movable track 102 is typically powered by an electric motor (not shown) using known mechanisms.

B. Attachment Apparatus

The attachment apparatus are configured to removably hold an engine valve. The attachment apparatus can have any shape so long as the engine valves can be positioned thereon and subsequently removed without damaging the engine valve. The attachment apparatus 106 can also be made from any material so long as the material can withstand the temperatures to which it will be exposed in the infrared oven. In an exemplary embodiment the attachment apparatus comprises steel.

Figure 2A:
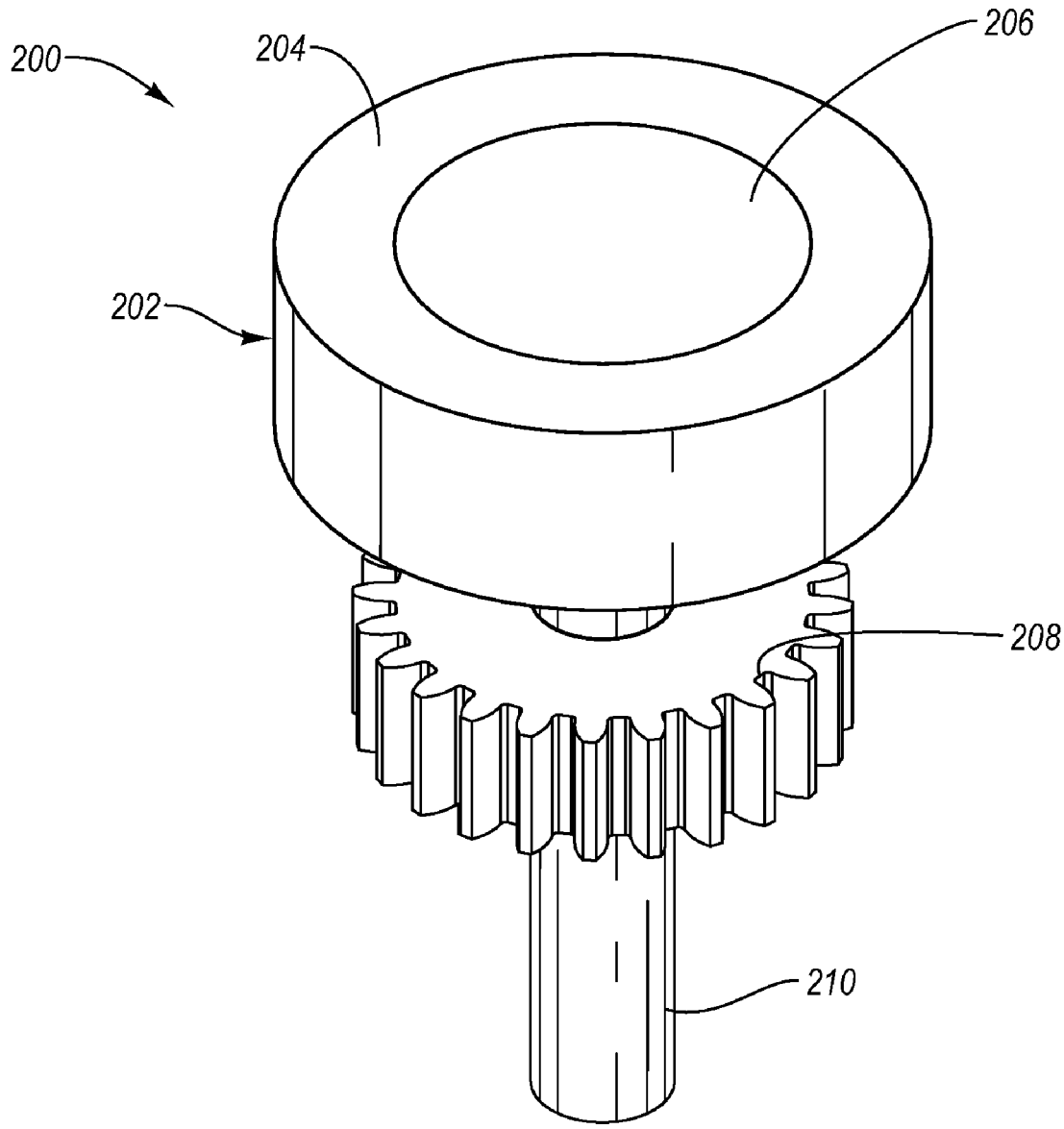
FIG. 2A is an exemplary embodiment of an attachment apparatus of the present invention that can be used in the system of FIG. 1.

FIG. 2A illustrates one exemplary embodiment of an attachment apparatus 200 having a configuration suitable for removably holding a typical engine valve. Attachment apparatus 200 includes a body of material 202 that has an upper surface 204 that is configured to receive an engine valve. In an exemplary embodiment, upper surface 204 is substantially circular on the sides and planer on the upper surface. This configuration is particularly suitable for receiving the bell end of a typical engine valve such as those described below with reference to FIGS. 3A and 3B.

Figure 2B:
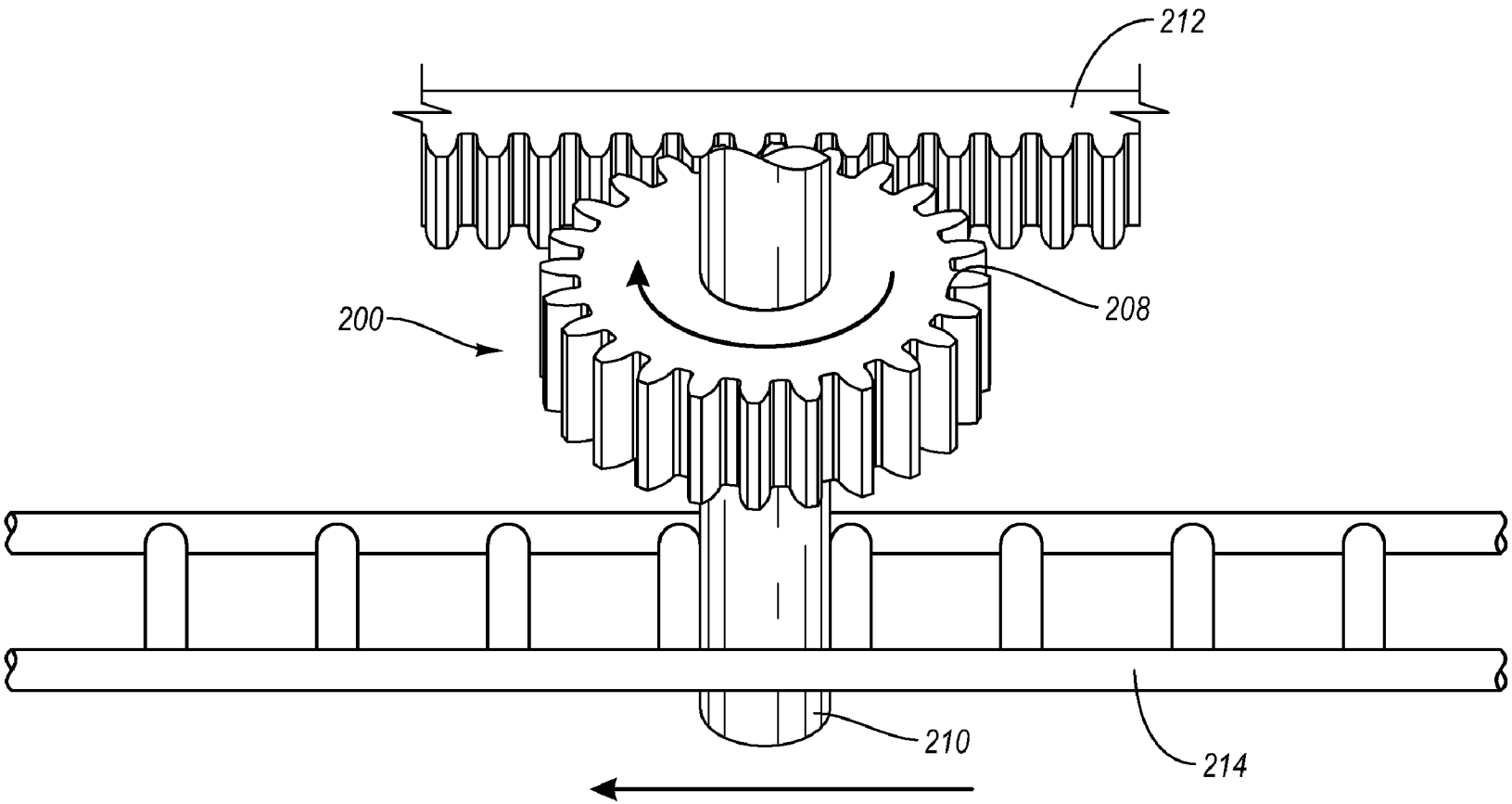
FIG. 2B shows an exemplary engagement mechanisms for causing the attachment apparatus of FIG. 2A to rotate.

The attachment apparatus 200 can also include a gear 208 attached to a stem 210. Gear 208 can be used to cause rotation of apparatus 200 and thus rotation of an engine valve attached thereto. Stem 210 can be made cylindrical such that it can rotate within an aperture of movable track 102. As shown in FIG. 2B, gear 208 is configured to engage a stationary gear 212 positioned adjacent to movable track 214. The stationary gear 212 can be positioned at only those locations around the movable track where it is desired that the engine valve spin, such as in infrared oven 104, in spraying region 110, and/or within preheating oven 108 (FIG. 1). The spinning motion of the engine valves can facilitate even heating, spraying, and/or curing. The rate at which apparatus 200 rotates will depend on the rate at which movable track 214 is moving and the gear size of gear 208. While the foregoing mechanism provides a simple and economical mechanism for causing rotation of the attachment apparatus and engine valves, the present invention is not limited to this particular mechanism; other mechanism can be used to cause rotation of the attachment apparatus of the present invention.

In a preferred embodiment, a portion of the attachment apparatus is made from a magnetic material to removably hold the engine valves thereto. As shown in FIG. 2A, attachment apparatus 200 includes a magnetic portion 206 that forms part of upper surface 204. The magnetic material advantageously holds a steel engine valve on apparatus 200. Removably holding engine valve on apparatus 200 using a magnet is particularly advantageous because the engine valves can be placed and removed very quickly and because this attachment mechanism is unlikely to cause scratches or other damage to the engine valve. Furthermore, the engine valves can be quickly loaded and/or unloaded from the attachment apparatus either through an automated process or manually.

C. Attachment Apparatus and Engine Valve Assembly

System 100 can be used to efficiently and economically coat a portion of an engine valve with a protective coating. The attachment apparatus, engine valve, and masking tooling can form an assembly.

1. Engine Valves

Figure 3A:
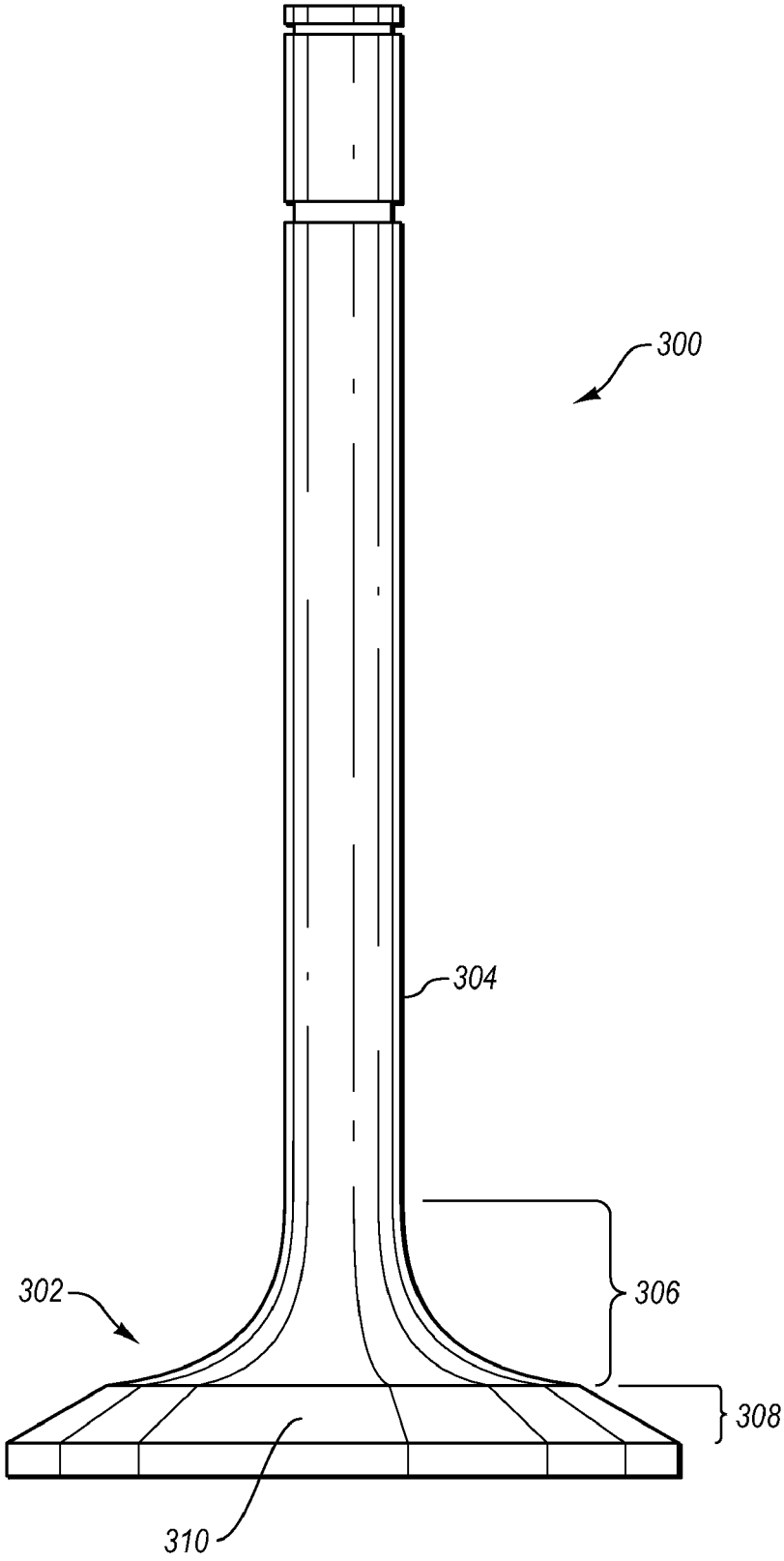
FIG. 3A shows an exemplary engine valve that can be attached to the attachment apparatus of FIG. 2A and coated using the system of FIG. 1.
Figure 3B:
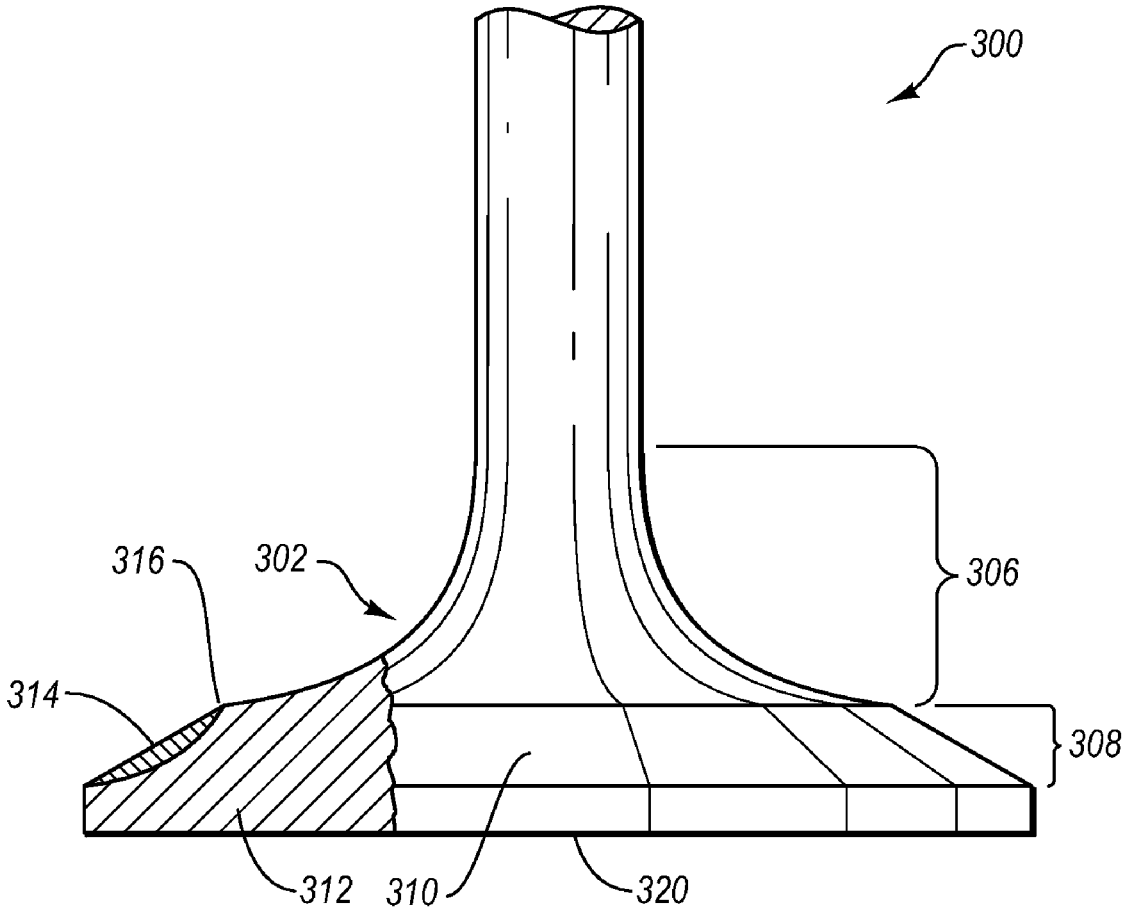
FIG. 3B is a partially sectioned view of the engine valve of FIG. 3A showing a cladding layer and cladding interface.

FIGS. 3A and 3B show a typical engine valve 300 that can be coated using system 100. The body of valve 300 includes a valve head 302 and a valve stem 304. The valve head 302 has a bell region 306 and a seating face 308. A portion of the seating face 308 functions as a valve seat 310. Valve seat 310 is the portion of seating face 308 that engages the air intake or exhaust port of the engine to form a seal.

The valve typically has a valve seat 310 made from a hard cladding material, typically a cobalt or nickel alloy. FIG. 3B shows the exemplary valve 300 with a portion of valve head 302 cut away to reveal the underlying structure of a typical valve head 302. Valve head 302 includes a valve body 312 and a cladding 314. Cladding 314 is made from a hard material suitable for use as a valve seat (e.g., cobalt-chromium alloys such as Stellite). The valve seat 310 is often subject to severe conditions and stress during use. Consequently, it is well known to use hard alloy materials such as cobalt or nickel alloys to improve the durability of the valve seat.

Valve body 312 is typically made from an inexpensive metal such as low carbon steel. While valve body 312 can be subject to relatively harsh operating conditions, the valve body 312 is typically not made from hard alloys due to cost.

The hard alloys of the cladding 314 and the softer metals of the valve body 312 abut one another to form a cladding-body interface 316 on the surface of valve head 302. If the valve is circular, the cladding-body interface will tend to be a curved line that is concentric with the seating face 308. However, the cladding-body interface need not be concentric with seating face 208. Furthermore, valve head 302 can have shapes other than "bell-shaped." During use of inlet valve 300 in an internal combustion engine, cladding-body interface 316 will be situated on the inside of the port (i.e., within the air intake or exhaust) when the valve is in the closed position. The bell end surface 320 is the end of the bell that will be situated on the inside of the combustion chamber during use.

2. Assembly

Figure 4:
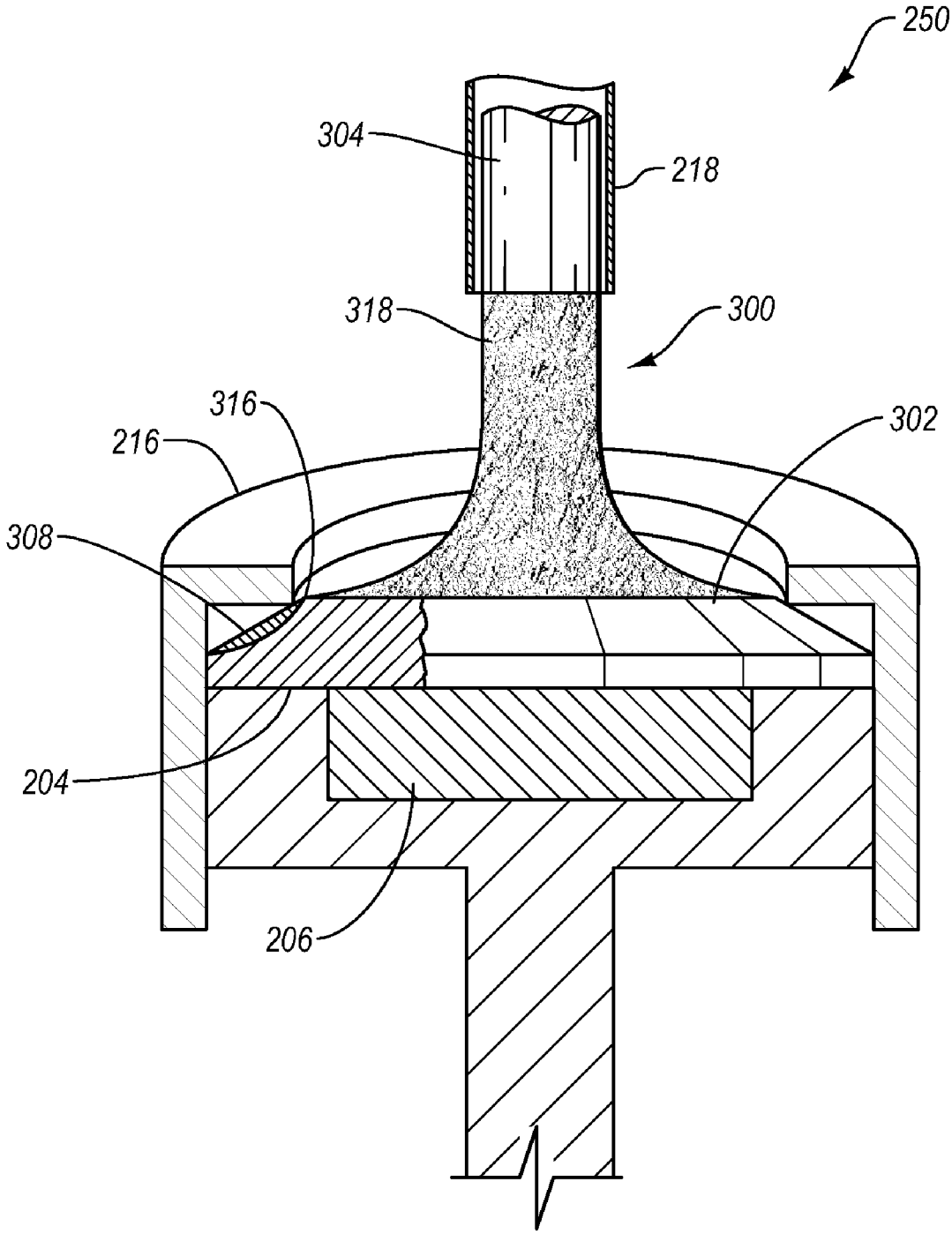
FIG. 4 shows an assembly of the attachment apparatus of FIG. 2A, the engine valve of FIG. 3A, and masking tooling.

FIG. 4 illustrates an attachment apparatus and engine valve assembly 250 according to one embodiment of the present invention. The bell end of engine valve 300 is disposed on the upper surface 204 of attachment apparatus 200. Magnetic portion 206 of attachment apparatus 200 exerts an attractive force on valve head 302 to removably hold engine valve 300 on attachment apparatus 200.

A masking tooling 216 is slidably placed over a portion of valve head 302. Masking tooling 216 can be a single ring having an aperture therethrough for receiving valve head 102. Masking tooling 216 has a first aperture with a width that is slightly larger than the width of valve head 302 and attachment apparatus 200 such that masking tooling 216 can be slidably received over valve head 302 and attachment apparatus 200. A second aperture is sized and configured to engage the seat face 308 so as to leave the portion 318 of engine valve 300 exposed. Masking tooling 216 engages the seating face 308 on the cladding so as to leave the cladding interface 316 exposed while covering the valve seat. This allows the coating to cover cladding interface 316 and extend slightly over a portion of the seating face 308, which minimizes corrosion and breakage in this region. The portion of engine valve 300 covered by masking tooling 216 is protected from the coating process of system 100.

Assembly 250 can also include a sleeve 218 that partially masks stem 304. Sleeve 218 is closed at one end and the length of sleeve 218 is selected such that the sleeve ends along valve stem 304 where the protective coating is to be applied. Sleeve 218 is preferably made from a soft metal such as aluminum to prevent the sleeve from scratching valve stem 304 as sleeve 218 is placed over and removed from stem 304.

Sleeve 218 and masking tooling 216 can be coated with a non-stick coating to hinder the bonding or adhesion of the protective coating composition to the tooling and sleeve. Examples of suitable non-stick coatings include polyfluorocarbons. Preventing the protective coating from adhering to the tooling and/or sleeve allows these parts to be reused many times for coating additional parts.

While the attachment apparatus in FIGS. 2A-2B, and FIG. 4 show an attachment apparatus and masking suitable for coating the "bell region" of an engine valve, the present invention also extends to attachment apparatus and masking for coating other areas of a valve. For example, the present invention can be used to coat the portion of the valve that is within the combustion chamber during combustion (i.e. the bell end 320). Protective coatings in this area of the valve can protect the valve from the wear and tear caused by combustion. An attachment apparatus for coating this portion of the engine valve is typically configured to receive the valve stem and has masking to block coating of the valve seat, for example.

Typically the engine valve is prepared in various ways before it is used in system 100 of the present invention. For example, the portion of the surface of the engine valve to be coated can be prepared to ensure good bonding between the valve and the coating. Preparing the surface typically includes cleaning and roughening the surface. In an exemplary embodiment, the surface is washed to remove lubricants and other materials that can affect bonding of the protective coating. Depending on the type of coating to be applied and the type and condition of the metal substrate, it can be advantageous to roughen the valve surface that is to be treated (e.g. by sand blasting).

D. Preheating Oven

With reference again to FIG. 1, system 100 can optionally include a preheating oven 108. The preheating oven can be any type of oven suitable for warming the engine valves. Preheating the engine valves helps prevent the coating composition from running or pooling, thereby ensuring a more even coating on the engine valve (e.g., by driving off a portion of the solvent by evaporation). In a preferred embodiment, the preheating oven 108 is an infrared oven having infrared lamps 120. Using an infrared preheating oven to heat the engine valves can be advantageous because the heating can be rapid. In a preferred embodiment, the attachment apparatus is configured to cause the engine valves to spin as they travel through the preheating oven so as to more evenly heat the engine valves.

E. Spraying Device and Coating Compositions

A spraying device 112 is used to apply a coating composition to the valves. The coating composition is typically stored in a reservoir that is in fluid communication with the spraying device 112. The spraying device 112 delivers the coating composition to at least a portion of the surface of the engine valve via a spray nozzle and/or a brush. If desired, the composition can be maintained under pressure, and the flow of coating composition can be manipulated by controlling the pressure and/or the size of the nozzle on the spraying device. The constituents in the coating composition can also affect the flow rate of the coating composition through the spraying device 112. For example the amount and type of solvents can affect the flowability of the coating composition. Thus the pressure and nozzle size will typically need to be selected according to the particular coating composition, and desired coating thickness. The spraying device 112 can be hand operated by a person or automated using a robot and a computerized controller.

In a preferred embodiment, the engine valves are caused to spin as they travel through spraying region 110. The rotation of the engine valves can assist in applying a uniform protective coating to the engine valves. In an exemplary embodiment a single thin coating of material is applied to each engine valve moving through region 110.

The coating can be any desired thickness so long as the thickness does not substantially interfere with valve movement or gas flow over the valve when the engine valve is used in an internal combustion engine. In a preferred embodiment, the coating thickness is in a range from about 0.0002 inch to about 0.002 inch. The desired thickness depends on the type of coating used and the amount of material needed to provide the desired protection. Relatively thin coatings are preferred due to the decreased cost and the increased simplicity with which the coating can be applied.

The coating compositions used in the system of the present invention are selected or manufactured to be curable in an infrared oven. In addition, the cured coatings are resistant to high temperatures such that the coating can withstand the extreme conditions of an internal combustion engine. In an exemplary embodiment the protective coating are stable and corrosion resistant to temperatures in a range from about 300° C. to about 1000° C.

1. Components Used To Make Coating Compositions

The protective coating compositions of the present invention generally include the following three components: (i) a metal and/or a ceramic material, (ii) a binder, and (iii) a solvent.

(i) Metals and Ceramic Materials

The coating compositions of the present invention include a metal oxide as a primary component and optionally metals as a secondary metallic component. In a preferred embodiment, the coatings include at least one metal oxide and at least one metal. The combination of metal oxides (i.e., ceramics) and metals can contribute to the high temperature and corrosion resistance of the cured coating and the high emissivity of the uncured coating compositions. In an exemplary embodiment, the metals and/or ceramics are provided as particulates. The particulates can have one or more sizes and can range in size from about 1 nm to about 1 mm.

A wide variety of ceramics and metals can be used in the protective coatings of the present invention. Suitable examples include silicon, zinc, zirconium, magnesium, manganese, chromium, titanium, iron, aluminum, noble metals, molybdenum, cobalt, nickel, tungsten oxides thereof, and combinations thereof Examples of suitable oxides include silica, calamine, zirconia, magnesia, titania, alumina, ceria, scandia, yttria, among others.

(ii) Binders

The binders used in the coating compositions of the present invention are typically organic or inorganic materials that can bind the metals or ceramics before or during curing. Examples of suitable organic binders such as ethylene copolymers, polyurethanes, polyethylene oxides, various acrylics, paraffin waxes, polystyrenes, polyethylenes, cellulosic materials, polysaccharides, starch, proteins, "agar," and other materials. Suitable inorganic binders include silicon based binders such as sodium silicate, kairome clay, titanium based binders such as titania sol and other inorganic binders such as aluminum phosphate.

(iii) Solvents

Any solvent can be used to combine and/or deliver the metal and/or ceramic material so long as the solvent is compatible with the particular metals and/or ceramics and binders being used. Examples of suitable solvents include polar solvents such as water, methanol, and ethanol and non-polar organic solvents such as benzene and toluene.

2. Manufacturing Coating Compositions

The coating compositions are made by selecting one or more metal oxides or metals, one or more binders, and one or more solvents and then mixing the components to form a paste or slurry. In an exemplary embodiment, the metal oxide is the predominant component. The metal oxide gives the protective coating heat resistance and resistance to corrosion. The metal oxide is typically included in an amount in a range from about 30 wt % to about 70 wt % of the coating composition (i.e. the uncured composition).

Metals can be included in the coating composition, typically in smaller amounts than the metal oxide. In a preferred embodiment, the amount of metal in the coating composition is in a range from about 0.5 wt % to about 20 wt %. The metals can give the coating toughness and heat resistance and help with the curing process.

The solvent is typically included in an amount that ranges from about 10 wt % to about 30 wt % of the coating composition. The solvent serves as a carrier or medium for mixing the metal oxides, metals, and binders. The consistency of the coating composition can be adjusted by adding greater or lesser amounts of solvent. If desired, the coating composition can be made into a slurry such that it can be applied by spray coating.

The metal oxides, metals, binders, and/or solvents are advantageously selected to give the uncured coating composition high emissivity. Protective coating compositions that have high emissivity can be cured at relatively low temperatures in the infrared oven 104 of system 100. The coating composition preferentially absorbs infrared energy, thus heating up, while low emissivity uncoated portions tend to reflect the infrared energy, thereby remaining cooler. In a preferred embodiment, the coating composition has an emissivity of greater than about 0.7, more preferably greater than about 0.9, and most preferably greater than about 0.95. The emissivity of a material can depend on the temperature. For purposes of the present invention, the emissivity value is based on the emissivity of the coating composition at the curing temperature.

The emissivity of the coating composition will depend on all the components in the coating. Typically, selection of the metal oxide has the most significant impact on the emissivity of the coating composition as a whole. Emissivity value for various suitable metal oxides is provided in Table 1.

TABLE 1

| Material | Temp (° C.) | Emissivity |
|---|---|---|
| 20-Ni, 24-Cr, 55-Fe, Oxidized | 500 | .97 |
| Iron, Oxidized | 499 | .84 |
| Molybdenum, Oxidized | 371 | .84 |
| Nickel Oxide | 538-1093 | .59-.86 |
| Platinum, Black | 260 | .96 |
| Titanium, Anodized onto SS | 93-316 | .96-.82 |
| Smooth Glass | 0-93 | .92-.94 |
| $Fe_2O_3$ | 24 | .91 |
| $Al_2O_3$ | 24 | .94 |
| ZnO | 24 | .95 |
| $MgCO_3$ | 24 | .91 |
| $ZrO_2$ | 24 | .95 |
| MgO | 24 | .91 |
| Glazed Silica | 1000 | .85 |

F. Infrared Ovens and Curing the Coating Composition

Once the coating composition has been applied to the desired portion of the valve, the valves are transported through infrared oven 104 where infrared radiation cures the coating composition. The high emissivity of the coating compositions allows efficient absorption of the infrared energy and results in quick and rapid curing. Infrared oven 104 can have any number of infrared lamps 122. In a preferred embodiment, the infrared lamps 122 are angled to apply direct radiation to the surface of the coating composition. In an exemplary embodiment, the engine valves are caused to rotate as the engine valves travel through the infrared oven 104 such that the valves are heated more uniformly.

To cause curing, the coating compositions are exposed to the infrared radiation so as to heat the coating composition to a temperature in a range from about 100° C. to about 650° C., more preferably in a range from about 200° C. to about 550° C., and most preferably in a range from about 250° C. to about 450° C.

In a preferred embodiment, the coating cures in less than about 0.5 hour, more preferably less than about 20 minutes, and most preferably in less than about 5 minutes. The ability to cure relatively quickly and/or at relatively low temperatures can dramatically reduce the energy requirements for applying the coating.

Any source of infrared radiation can be used so long as the intensity is sufficient to raise the temperature of the coating to the desired curing temperature. Suitable sources of infrared radiation include gas or electric powered infrared lamps. Electric powered lamps are typically preferred for their ability to reach hotter temperatures and/or better control of the temperature. Gas fired IR lamps are typically preferred for their lower cost of operation.

Curing the protective coatings using infrared radiation can be advantageous because the coating can be cured rapidly with good uniformity. In addition, the relatively low temperatures needed to cure the high emissivity coatings minimizes the energy costs associated with curing, thereby improving the cost effectiveness of the process G. Automation Control panel 118, shown in FIG. 1, can be used to provide automation to the system. Control panel 118 typically includes microprocessors and/or other circuitry that can monitor and/or control the performance of one or more components of system 100. In an exemplary embodiment, control panel 118 controls the rate of travel for movable track 102 and/or the intensity and/or duration of the emission of infrared radiation from preheating oven 108 and/or infrared oven 104. The control panel 118 facilitates automation to reduce costs and increase output.

The present invention may be embodied in other specific forms without departing from its spirit or essential characteristics. The described embodiments are to be considered in all respects only as illustrative and not restrictive. The scope of the invention is, therefore, indicated by the appended claims rather than by the foregoing description. All changes which come within the meaning and range of equivalency of the claims are to be embraced within their scope.

What is claimed is:

1. A system for coating an engine valve, comprising:

an infrared oven comprising at least one infrared lamp;

a movable track forming a loop, a portion of the track being disposed within the infrared oven;

a plurality of engine valves having a valve head and a valve stem, the valve head having a valve seat and comprising a bell region;

a plurality of attachment apparatus connected to the movable track, each attachment apparatus configured to receive and hold an engine valve on the track as the track moves and having a masking tooling received over a portion of the valve head of the engine valve, the masking tooling providing a mask for a portion of the valve seat;

a spraying device configured to apply a coating composition to the plurality of engine valves disposed on the plurality of attachment apparatus as the engine valves pass through a spraying region, the spraying device being disposed along the movable track before the infrared oven; and wherein each attachment apparatus is configured to rotate the engine valve about an axis of the engine valve as the attachment apparatus passes through the spraying region.

2. A system as in claim 1, in which an energy output of the infrared oven is set so as to heat a coating within the oven to a temperature in a range from about 100° C. to about 650° C.

3. A system as in claim 1, in which an energy output of the infrared oven is set so as to heat a coating within the oven to a temperature in a range from about 200° C. to about 550° C.

4. A system as in claim 1, further comprising a preheater positioned along the movable track before the spraying device, such that engine valves being held on the movable track will be heated prior to being coated by the spraying device.

5. A system as in claim 1, further comprising a reservoir of coating composition in fluid communication with the spraying device, the coating composition comprising an aqueous slurry.

6. A system as in claim 1, further comprising an electronic control system that allows a user to input a desired speed of the movable track and controls the speed of the movable track based on the user input.

7. A system as in claim 6, in which an electronic control panel simultaneously controls the speed of the movable track and the temperature of the infrared oven, thereby controlling a drying time of engine valves within the infrared oven.

8. A system as in claim 7, in which the drying time is less than 30 minutes.

9. A system as in claim 7, in which the drying time is less than 5 minutes.

10. A system as in claim 1, in which the plurality of attachment apparatus are configured to rotate about a vertical access when the plurality of attachment apparatus are moving through at least a portion of the infrared oven.

11. A system for coating an engine valve, comprising:

an infrared oven comprising a plurality of infrared lamps;

a movable track forming a loop, a portion of the track being disposed within the infrared oven;

a stationary gear positioned within the infrared oven adjacent to the movable track; and a plurality of attachment apparatus rotatably connected to the movable track and configured to receive and hold an engine valve on the track as the track moves, each attachment apparatus comprising a gear that rotates the attachment apparatus and the engine valve about a vertical axis when engaged with the stationary gear; and a spraying device configured to apply a coating composition to the plurality of engine valves disposed on the plurality of attachment apparatus, the spraying device being disposed along the movable track before the infrared oven.

12. A system as in claim 11, wherein each attachment apparatus is configured to rotate the engine valve about an axis of the engine valve as the attachment apparatus moves through a spraying region.

13. A system as in claim 11, in which an energy output of the infrared oven is set so as to heat a coating within the oven to a temperature in a range from about 200° C. to about 550° C.

14. A system as in claim 11, in which an energy output of the infrared oven is set so as to heat a coating within the oven to a temperature in a range from about 250° C. to about 450° C.

15. A system as in claim 11, in which the attachment apparatus comprises a magnet.

16. A system as in claim 11, further comprising an electronic control panel that controls a speed of the movable track.

17. An assembly for masking an engine valve to be coated with a composition, comprising:

an attachment apparatus comprising a body of material having an upper surface configured to receive an engine valve, the attachment apparatus having a gear configured to rotate the attachment apparatus about a vertical axis when engaged with a corresponding gear;

an engine valve having a valve head and a valve stem, the valve head having a valve seat face and comprising a bell region and an end surface region, wherein at least a portion of the end surface region is disposed on the upper surface of the attachment apparatus; and a masking tooling slidably received over a portion of the valve head and the attachment apparatus so as to sandwich at least a portion of the valve head between the attachment apparatus and the masking tooling, the masking tooling providing a mask for a first portion of the valve seat face and leaving a second portion of the valve seat face exposed for receiving a coating.

18. An assembly as in claim 17, in which the attachment apparatus comprises a magnet.

19. An assembly as in claim 17, in which the end surface of the bell region has a substantially planar-circular shape.

20. An assembly as in claim 17, further comprising a sleeve that is received over a portion of the valve stem.

21. An assembly as in claim 17, wherein the masking tooling has a coating comprising a polyfluorocarbon.

22. A system for coating an engine valve, comprising:

an infrared oven comprising a plurality of infrared lamps;

a movable track forming a loop, a portion of the track being disposed within the infrared oven; and a plurality of attachment apparatus rotatably connected to the movable track and configured to receive and hold an engine valve on the track as the track moves, each attachment apparatus comprising a gear that rotates the attachment apparatus;

means for rotating the engine valve about a vertical axis of the engine valve when the engine valve is positioned within the infrared oven; and a spraying device configured to apply a coating composition to the plurality of engine valves disposed on the plurality of attachment apparatus, the spraying device being disposed along the movable track before the infrared oven.

23. A system as in claim 22, further comprising means for rotating the engine valve about the vertical axis of the engine valve when the engine valve is positioned in a spraying region.

* * * * *

UNITED STATES PATENT AND TRADEMARK OFFICE

CERTIFICATE OF CORRECTION

PATENT NO. : 7,559,991 B2
APPLICATION NO. : 11/458634
DATED : July 14, 2009
INVENTOR(S) : Burton et al.

It is certified that error appears in the above-identified patent and that said Letters Patent is hereby corrected as shown below:

Title Page

Item 56, References Cited, Other Publications, Page 2, change "Kawana, A., Surface & Coatings Technology v 86-87 n 1-3 pt 1 Dec. 1, 1996.p 212-217, Proceedings of the 1996 23rd International Conference of Metallurtical Coating and Thin Films, 1997(13):2038 Compendex." to --Kawana, A., Surface & Coatings Technology v 86-87 n 1-3 pt 1 Dec. 1, 1996. p 212-217, Proceedings of the 1996 23rd International Conference of Metallurgical Coatings and Thin Films, 1997(13):2038 Compendex.--

Item 56, References Cited, Other Publications, Page 2, change "Herzog, CFI Ceramic Forum International v 79 n 8 Aug. 2002 2002.p D15-D17+E14-E16; 2002(38):3338 Compendex." to --Herzog, CFI Ceramic Forum International v 79 n 8 Aug. 2002. p D15-D17+E14-E16; 2002(38):3338 Compendex.--

Column 3

Line 23, change "man power" to --manpower--
Line 66, change "mechanisms" to --mechanism--

Column 4

Line 34, change "spray coated" to --spray-coated--
Line 60, change "embodiment" to --embodiment,--

Column 5

Line 9, change "102." to --102 (FIG. 1).--

Column 6

Line 7, change "face 208." to --face 308.--
Line 24, change "valve head 102." to --valve head 302.--

Column 7

Line 39, change "For example" to --For example,--

Column 8
Line 1, change "embodiment" to --embodiment,--
Line 1, change "coating are" to --coating is--
Line 26, change "thereof Examples" to --thereof. Examples--
Line 33, change "binders such as" to --binders include--

Signed and Sealed this

Nineteenth Day of January, 2010

David J. Kappos

David J. Kappos
*Director of the United States Patent and Trademark Office*